US005253867A

United States Patent [19]

Gafner

[11] Patent Number: 5,253,867

[45] Date of Patent: Oct. 19, 1993

[54] MULTI-COMPONENT SHAFT FOR GOLF CLUBS

[76] Inventor: Donald M. Gafner, c/o Dallas Golf Co., 46 Broadway Sq., Mesquite, Tex. 75150

[21] Appl. No.: 729,887

[22] Filed: Jul. 11, 1991

Related U.S. Application Data

[63] Continuation of Ser. No. 568,612, Aug. 16, 1990, abandoned, which is a continuation of Ser. No. 413,127, Sep. 27, 1989, abandoned.

[51] Int. Cl.[5] ..... A63B 53/10

[52] U.S. Cl. ..... 273/80 R; 273/80 B; 273/DIG. 23

[58] Field of Search ..... 273/80 R, 80 B, 77 R, 273/77 A, DIG. 7, DIG. 23, 67 R, 67 A, 72 A

[56] References Cited

U.S. PATENT DOCUMENTS

| | | | |
|---|---|---|---|
| 1,098,630 | 6/1914 | Mackie | 273/80.3 |
| 1,143,376 | 6/1915 | Fogg | 273/67 A |
| 1,680,447 | 8/1928 | Bryant | 273/80 R |
| 1,904,750 | 4/1933 | Reach | 273/80 R |
| 1,968,616 | 7/1934 | Oldham | 273/80 R X |
| 2,095,563 | 10/1937 | Cowdery | 273/80 R X |
| 2,809,144 | 10/1957 | Grimes | 273/80 B |
| 3,873,090 | 3/1975 | Thompson | 273/80.8 |
| 3,878,012 | 4/1975 | Williams | 273/80 R X |
| 4,470,600 | 11/1984 | Parente et al. | 273/80 B |
| 4,725,060 | 2/1988 | Iwanaga | 273/77 A |
| 4,836,545 | 6/1989 | Pompa | 273/80 B |
| 5,026,063 | 6/1991 | Rhodes | 273/80 B X |

FOREIGN PATENT DOCUMENTS

| | | | |
|---|---|---|---|
| 705035 | 3/1965 | Canada | 273/72 R |
| 427717 | 4/1935 | United Kingdom | 273/80 R |
| 2053698 | 2/1981 | United Kingdom | 273/80 B |

*Primary Examiner*—V. Millin
*Assistant Examiner*—Sebastiano Passaniti
*Attorney, Agent, or Firm*—Ronald P. Kananen

[57] ABSTRACT

A shaft, suitable for use as a golf club shaft, having a metallic club and adjoining a fiber grip end. Preferably, the metallic end is solid or hollow, while the grip end is made from fibers such as carbon or graphite, boron, or a mixture. The method of making the shaft is also disclosed.

4 Claims, 3 Drawing Sheets

MULTI-COMPONENT SHAFT FOR GOLF CLUBS

This application is a continuation of application Ser. No. 07/568,612 filed Aug. 16, 1990, which is a continuation of application Ser. No. 07/413,127, filed Sep. 27, 1989, both now abandoned.

BACKGROUND OF THE INVENTION

This invention relates to a multi-component elongated shaft, especially suited for golf clubs. More particularly, this invention relates to a shaft for a golf club having a metal portion adjacent the club end and a composite portion, made from a material such as graphite or boron/graphite fibers, at the grip end. Still more particularly, this invention relates to such a golf club shaft and a method of making the same wherein a composite grip end portion is joined to and merges with a metallic club end portion.

A golf club shaft is provided with a number of characteristics of length, weight, balance, diameter, and taper to impart an appropriate "feel" to its user, and to mechanically transfer power and speed during its stroke to the golf ball. Historically, such shafts have been made from a number of different types of materials. For example, wooden shafts were originally quite popular but were eventually replaced with lightweight hollow metallic shafts. Later, composite materials such as fiber reinforced plastic replaced metallic shafts for weight reduction.

Shafts having multiple components are known to the art, such as are discussed in U.S. Pat. No. 4,725,060, for example. Such clubs include reinforcing filaments such as carbon filaments nown filament winding method.

The use of a graphite filament tubular shaft is known from U.S. Pat. No. 3,873,090. There, a steel hosel and a graphite filament shaft 12 are joined by an elongated pin inserted into a bore in the shaft and a suitable bonding agent. Similarly, in U.S. Pat. No. 4,555,113, a shaft body is prepared by rolling an inorganic fiber sheet made of fiberglass carbon cloth, boron fiber cloth, or a combination thereof into a multi-layered cylindrical body which is adhered to a plastic resin layer.

However, it has remained a problem in the art to continue to produce the correct "feel" for the golf club while utilizing graphite or boron/graphite materials. Thus, it is desired to preserve the center of gravity of the club nearer to the club face while obtaining the advantages of the use of lighter weight materials.

Accordingly, it is an overall object of this invention to prepare a shaft especially suited for use with a golf club which comprises a metal portion joined with a composite material portion at a location spaced along the length of the shaft.

It is an additional object of this invention to provide a shaft having a metal portion at the club end of a golf shaft adjoining a graphite portion at the grip end of the shaft.

It is still another object of this invention to provide a golf shaft with a hollow tubular metallic portion adjoining a fiber composite portion so that the center of gravity of the shaft lies nearer to the club end than to the grip end.

These and other objects of the invention will become apparent from a detailed description of the invention which follows taken in conjunction with the accompanying drawings.

BRIEF SUMMARY OF THE INVENTION

Directed to achieving the foregoing objects and overcoming the problems with the prior art golf shafts, the invention comprises an elongated shaft comprising a metal portion adjoining a composite portion. Preferably, the metal portion is a hollow tubular portion to which is adjoined a graphite composite portion, or a boron/graphite portion. The structure of the invention thus places the center of gravity of the shaft nearer to the club end than to the grip end and at a location along the metal shaft.

A method of making such a shaft comprises the steps of providing a metal shaft; wrapping a graphite, boron/graphite, or fiberglass material in an uncured state in a predetermined orientation about a mandrel to a predetermined location; joining the metal shaft to the uncured material; continuing to wrap the material over the mandrel until the desired length of the shaft is produced to a desired thickness or diameter; allowing the material to cure; and finishing the shaft by grinding the shaft to a smooth joint. The metallic shaft may be a hollow, tubular, or a solid shaft.

These and other features of the invention will become apparent from the detailed description of the invention which follows taken with the accompanying drawings.

DETAILED DESCRIPTION OF THE PREFERRED EMBODIMENT

Figure 1:
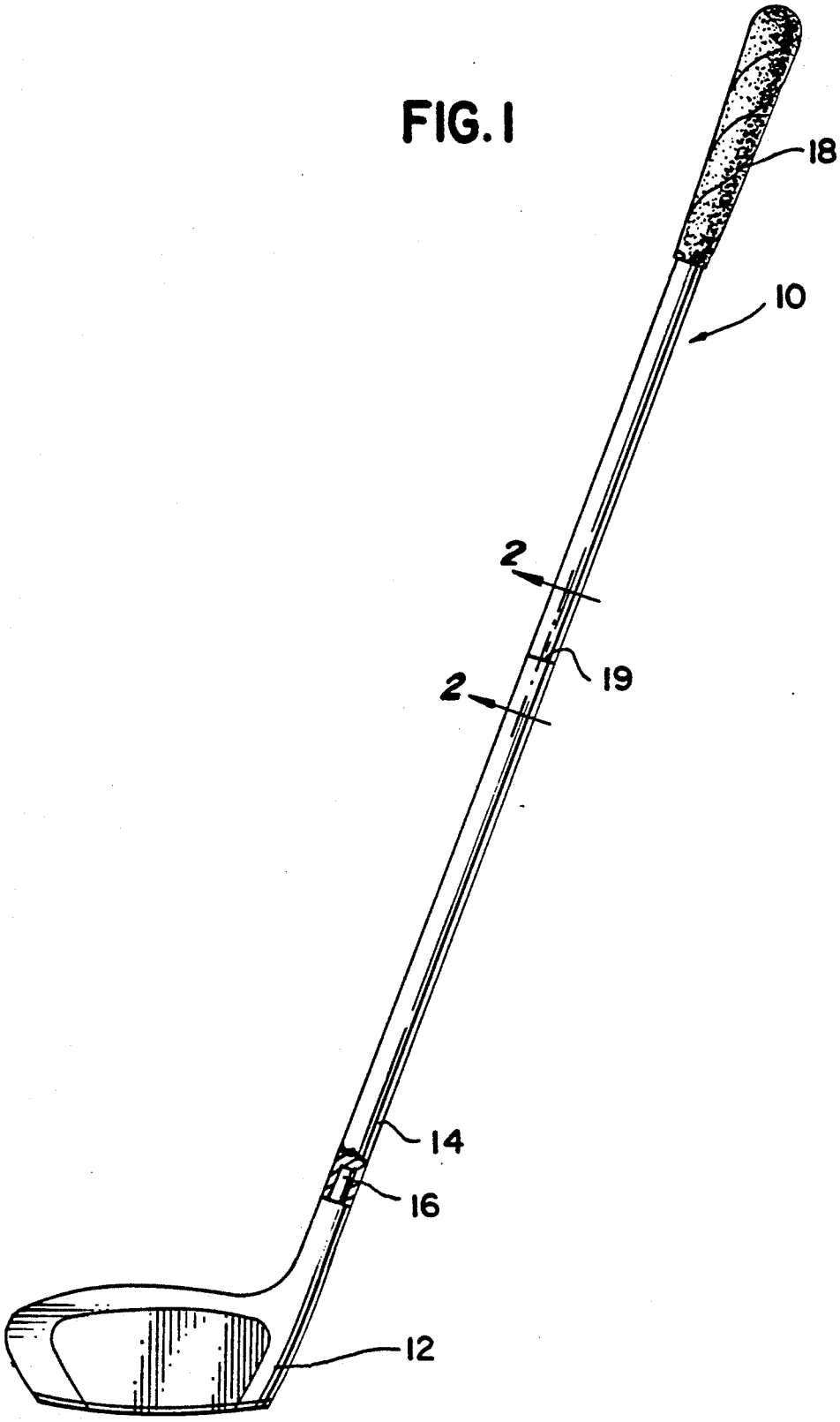
FIG. 1 is a side elevational view of a golf club incorporating a shaft according to the invention.

An elongated shaft according to the invention is shown in FIG. 1 and identified by the reference numeral 10. As shown, the shaft 10 is used as a shaft of a golf club having a club head 12 secured to a club end 14 of the shaft 10 in a conventional manner. For example, the club end 14 of the shaft 10 may be inserted about a mating projection 16 of the club head 12 and the area of joinder between them suitably sealed and smoothed. The end 18 of the shaft 10 opposite the club end 14 acts as a grip end 18 of the shaft and may be suitably wrapped with a gripping material such as leather, a moisture-absorbent wrapping or the like.

A main feature of the invention resides in the fact that the club end 14 of the shaft 10 is made from a suitable metal used in golf clubs, such as a hollow tubular stainless steel or a metallic alloy material, while the grip end 18 of the shaft end is made from a fiber composite material known to the art. The composite material adjoins the metal at the region 19, which may preferably lie at about the midpoint of the club. For example, the composite material may be made from a graphite fiber material, a boron fiber material, or a boron/graphite material, suitably prepared as a composite. Preferably, the graphite fibers are mixed and impregnated with a liquid resin for adhesion to each other and to a mandrel, as seen in steps 29 and 30 in FIG. 4. A plurality of layers of such material are provided in a sheet form and laidup one upon the other to provide a desired wall thickness of a club shaft, as seen in step 31. When boron and carbon or graphite fibers are used, the steps are the same.

An advantage of a golf club using a shaft 10 according to the invention is that it provides a suitable "feel" for its user resulting from the combination of the weight and strength of the metal at the club end combined with the strength and lightness of the composite material at the grip end. Because such shafts are usually tapered, an all-metal shaft usually has its center of gravity and center of rotation at a location slightly toward the grip end 18 of the shaft, assuming a constant density metallic material. With the shaft of the invention, the center of rotation and the center of gravity of the shaft lie significantly below the midpoint of the shaft as measured along its length and toward the club end 16. As a result, the user is able to transfer power simply, conveniently, and with strength to the ball.

Figure 2:
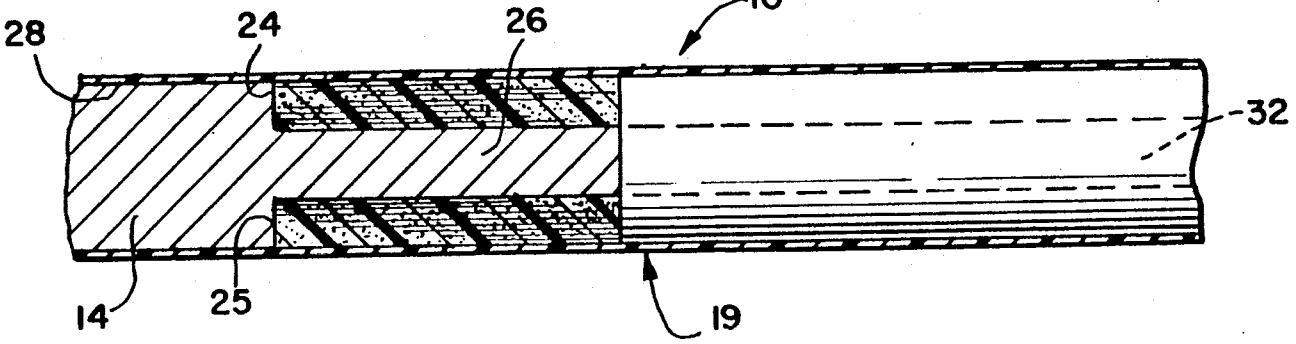
FIG. 2 is a side cross-sectional view of a portion of the shaft of FIG. 1 taken along line 2—2 showing a stepped portion on a solid metal shaft portion for joining the fiber composite portion.

FIG. 2 shows in greater detail the area 19 of abutment between the metallic club end for a solid metallic shaft 14 and the composite grip end 18. There, as a representative example, the metallic portion of the solid shaft is stepped at a predetermined location 24 along the length of the shaft 10 to define a region of a smaller diameter 26 adjacent a region of a larger diameter 28 and an adjoining shoulder 25. During manufacture, the layers of the impregnated graphite or boron/graphite fibers are wrapped on a mandrel 32, as noted in FIG. 4, to a diameter 32 about equal to that of the region of smaller diameter 26 of the metallic shaft. The metal shaft 14 is then abutted to the fiber material and the wrap is continued to wrap over the mandrel and the metallic shaft at its diameter 26 until the shaft is built up to its desired thickness and the region of smaller diameter 26 is built up with the impregnated fibers. The length of the region of smaller diameter 26 may vary depending on the joint strength needed for the club as a function of the materials used, and the length of the club. As an example, a club shaft is usually about 44" long, and the length of the metal shaft may vary about the 22" region of the shaft when measured from either end. All of the variables are taken into account based on the specifications of the manufacturer for stiffness to produce a club with desired feel and stiffness.

Figure 3:
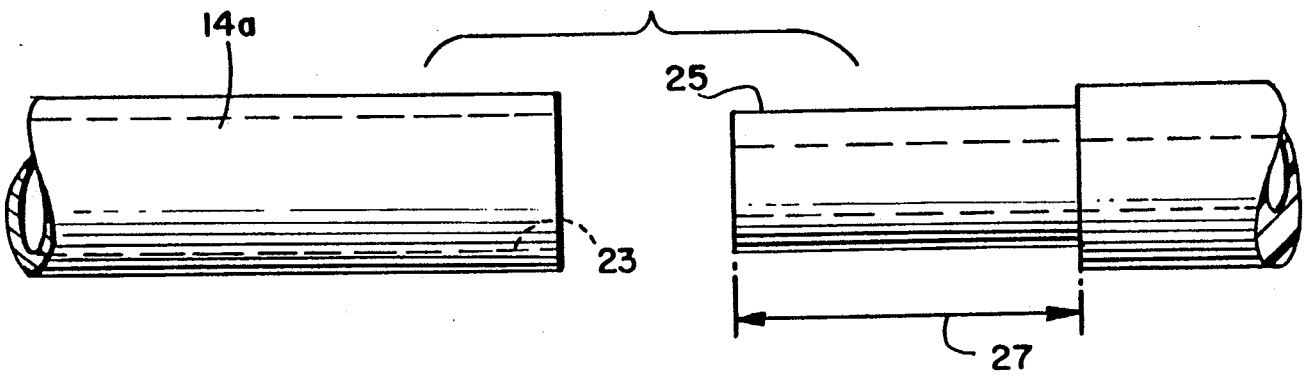
FIG. 3 is an exploded view of the two components of the shaft of FIG. 1 showing a stepped portion on the graphite shaft portion for joining with a hollow, or tubular metallic shaft.

FIG. 3 shows an alternative method for making the shaft 10 using a hollow or tubular metallic shaft 14*a*. The metal shaft 10 assumes the form of a hollow metal shaft 14*a* having a wall thickness defining an inner diameter 23 for mating with a projecting portion 25 of a graphite shaft made as described above. The end of the graphite shaft has a region of smaller diameter 25 having a length 27 which varies in the same manner as previously described. When the composite is made from graphite and boron fibers, the steps are the same.

Figure 4:
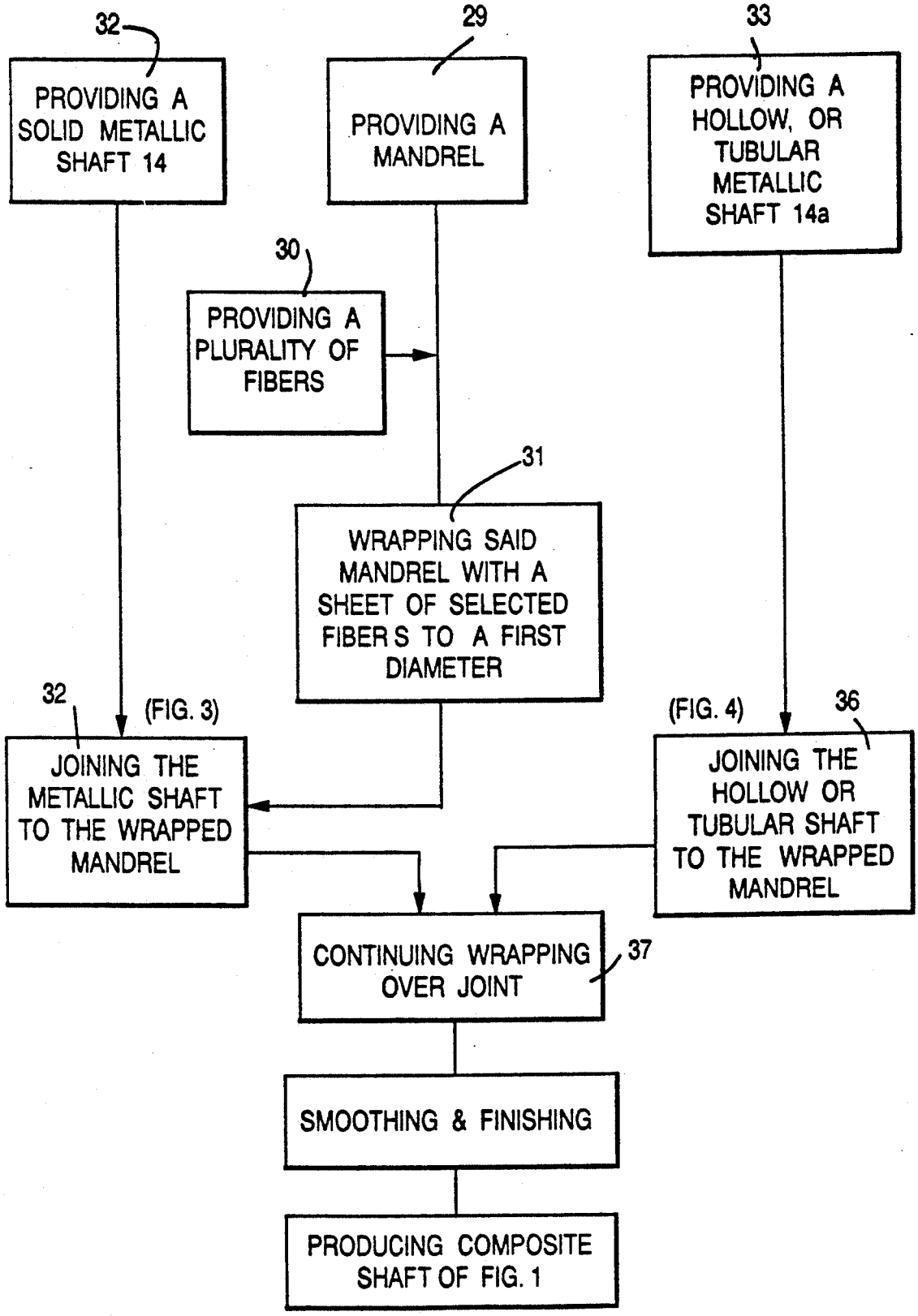
FIG. 4 is a block design useful in describing a method for making the shaft of FIG. 1.

FIG. 4 is a block diagram useful in recapitulating the method of making a shaft 10 according to the invention for either case of a hollow metallic shaft 14*a* or a solid metallic shaft 14. As to the composite grip portion of the shaft 18, a mandrel is provided at step 29. A plurality of selected fibers, such as graphite, boron, or a mixture of graphite and boron, are mixed with an uncured adhesive resin, as is known in the art, to provide a plurality of fibers in sheet form as noted in step 30. The mandrel is thus wrapped with a sheet of fibers to a first selected diameter, whether for a solid metallic shaft as in FIG. 2, or for a hollow metallic shaft as in FIG. 3, as noted in step 31. When a solid metallic shaft is used, as in FIG. 3, the diameter is about the same as the region of smaller diameter 26 of the stepped down shaft. When the shaft is hollow, the diameter wrap is about equal to the inside diameter 23 of the shaft 14*a*.

A solid metallic shaft 14 having the end configuration of FIG. 2 is provided at step 32, or a hollow metallic shaft 14*a* is provided as in step 33. The shafts 14, 14*a* are then joined to the wrap in steps 35, 36 respectively and the wrap continued over the area of joinder as in step 37. When the shaft is built to its final diameter, the shaft is smoothed as at step 39 and the shaft of FIG. 1 is thus produced.

The invention this has been described in a way which supports the following claims and the advantages asserted.

I claim:

1. A shaft for a golf club comprising a metallic shaft abutting a composite material in an end-to-end relationship at a location along the length of the shaft wherein said metallic shaft includes a solid metallic shaft and wherein said solid metallic shaft defines a region of smaller diameter adjacent an end, a portion of the composite material being wrapped about said sampler diameter portion.

2. The shaft as set forth in claim 1 wherein said composite material includes carbon fibers.

3. The shaft as set forth in claim 1 wherein said composite material includes boron fibers.

4. The shaft as set forth in claim 1 wherein said composite material includes a mixture of boron fibers and carbon fibers.

* * * * *